US009383104B2

(12) United States Patent
Melton et al.

(10) Patent No.: US 9,383,104 B2
(45) Date of Patent: Jul. 5, 2016

(54) CONTINUOUS COMBUSTION LINER FOR A COMBUSTOR OF A GAS TURBINE

(71) Applicant: General Electric Company, Schenectady, NY (US)

(72) Inventors: Patrick Benedict Melton, Horse Shoe, NC (US); Lucas John Stoia, Taylors, SC (US); Richard Martin DiCintio, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 618 days.

(21) Appl. No.: 13/845,384

(22) Filed: Mar. 18, 2013

(65) Prior Publication Data

US 2014/0260273 A1 Sep. 18, 2014

(51) Int. Cl.

| | |
|---|---|
| ***F02C 1/00*** | (2006.01) |
| ***F23R 3/00*** | (2006.01) |
| *F23R 3/34* | (2006.01) |
| *F01D 9/02* | (2006.01) |

(52) U.S. Cl.

CPC ..... *F23R 3/002* (2013.01); *F01D 9/023* (2013.01); *F23R 3/34* (2013.01); *F23R 3/346* (2013.01)

(58) Field of Classification Search

CPC ..... F23R 3/346; F23R 3/34; F23R 3/286; F23R 3/36; F01D 9/023

See application file for complete search history.

(56) References Cited

U.S. PATENT DOCUMENTS

| | | | | |
|---|---|---|---|---|
| 3,872,664 | A | 3/1975 | Lohmann | |
| 4,265,615 | A | 5/1981 | Lohmann | |
| 4,420,929 | A | 12/1983 | Jorgensen | |
| 5,069,029 | A | 12/1991 | Kuroda | |
| 5,380,154 | A | 1/1995 | Norton | |
| 5,450,725 | A | 9/1995 | Takahara | |
| 5,475,979 | A | 12/1995 | Oag | |
| 5,802,854 | A | 9/1998 | Maeda | |
| 6,047,550 | A * | 4/2000 | Beebe | F23L 7/00 60/733 |
| 6,148,604 | A | 11/2000 | Salt | |
| 6,212,870 | B1 | 4/2001 | Thompson et al. | |
| 6,374,594 | B1 | 4/2002 | Kraft et al. | |
| 6,442,946 | B1 | 9/2002 | Kraft | |
| 6,450,762 | B1 | 9/2002 | Munshi | |

(Continued)

FOREIGN PATENT DOCUMENTS

| | | | |
|---|---|---|---|
| EP | 0526058 | A1 | 3/1993 |
| EP | 0578461 | A1 | 12/1994 |
| EP | 1884297 | A1 | 2/2008 |

OTHER PUBLICATIONS

Co-Pending U.S. Appl. No. 13/845,439, filed Mar. 18, 2013.

(Continued)

*Primary Examiner* — Gerald L Sung
(74) *Attorney, Agent, or Firm* — Dority & Manning, PA

(57) ABSTRACT

A combustion liner for a gas turbine combustor includes an annular main body having a forward end axially separated from an aft end, and a transitional intersection defined between the forward end and the aft end. The main body extends continuously from the forward end to the aft end. A plurality of fuel injector passages extend radially through the main body upstream from the transitional intersection. The main body comprises a conical section having a circular cross section that diverges between the forward end and the transitional intersection, and a transition section having a non-circular cross section that extends from the transitional intersection to the aft end of the main body.

12 Claims, 7 Drawing Sheets

(56) References Cited

U.S. PATENT DOCUMENTS

| | | | | |
|---|---|---|---|---|
| 6,543,993 | B2 | 4/2003 | Burdgick et al. | |
| 6,654,710 | B1 | 11/2003 | Keller | |
| 6,875,009 | B2 | 4/2005 | Kayahara et al. | |
| 6,896,509 | B2 | 5/2005 | Carroni et al. | |
| 6,957,949 | B2 | 10/2005 | Hyde et al. | |
| 7,082,766 | B1 | 8/2006 | Widener et al. | |
| 7,743,612 | B2 | 6/2010 | Morenko | |
| 8,096,131 | B2 | 1/2012 | Ziaei et al. | |
| 8,158,428 | B1 | 4/2012 | Krishna | |
| 8,171,738 | B2 | 5/2012 | Fish et al. | |
| 2002/0184893 | A1* | 12/2002 | Farmer | F23R 3/06 60/804 |
| 2003/0039542 | A1 | 2/2003 | Cromer | |
| 2005/0044855 | A1 | 3/2005 | Crawley | |
| 2005/0241317 | A1* | 11/2005 | Martling | F01D 9/023 60/772 |
| 2005/0268617 | A1 | 12/2005 | Amond | |
| 2008/0282667 | A1* | 11/2008 | Intile | F01D 9/023 60/39.37 |
| 2009/0071157 | A1 | 3/2009 | Cai | |
| 2009/0199561 | A1 | 8/2009 | Hessler | |
| 2010/0054928 | A1 | 3/2010 | Schiavo | |
| 2010/0071377 | A1* | 3/2010 | Fox | F23R 3/16 60/740 |
| 2010/0139283 | A1 | 6/2010 | Phillips et al. | |
| 2010/0170216 | A1 | 7/2010 | Venkataraman | |
| 2010/0174466 | A1 | 7/2010 | Davis, Jr. et al. | |
| 2010/0263386 | A1 | 10/2010 | Edwards | |
| 2011/0067402 | A1 | 3/2011 | Wiebe | |
| 2011/0146284 | A1 | 6/2011 | Morimoto | |
| 2011/0247314 | A1 | 10/2011 | Chila | |
| 2011/0304104 | A1 | 12/2011 | McMahan | |
| 2012/0186260 | A1 | 7/2012 | DiCintio et al. | |
| 2012/0210729 | A1 | 8/2012 | Cihlar et al. | |
| 2012/0304648 | A1 | 12/2012 | Byrne | |
| 2014/0033728 | A1* | 2/2014 | Marmilic | F02C 7/141 60/772 |
| 2014/0260272 | A1 | 9/2014 | DiCintio | |

OTHER PUBLICATIONS

Co-Pending U.S. Appl. No. 13/845,365, filed Mar. 18, 2013.
Co-Pending U.S. Appl. No. 13/845,485, filed Mar. 18, 2013.
Co-Pending U.S. Appl. No. 13/845,565, filed Mar. 18, 2013.
Co-Pending U.S. Appl. No. 13/845,617, filed Mar. 18, 2013.
Co-Pending U.S. Appl. No. 13/845,661, filed Mar. 18, 2013.
Co-Pending U.S. Appl. No. 13/845,699, filed Mar. 18, 2013.
Co-Pending U.S. Appl. No. 13/845,378, filed Mar. 18, 2013.

* cited by examiner

CONTINUOUS COMBUSTION LINER FOR A COMBUSTOR OF A GAS TURBINE

FIELD OF THE INVENTION

The present invention generally involves a combustor of a gas turbine. More specifically, the invention relates to a hot gas path duct or liner for a gas turbine.

BACKGROUND OF THE INVENTION

A combustion section of a can annular gas turbine generally includes a plurality of combustors that are arranged in an annular array around a compressor discharge casing. Pressurized air flows from a compressor to the compressor discharge casing and is routed to each combustor. Fuel from a fuel nozzle is mixed with the pressurized air in each combustor to form a combustible mixture within a primary combustion zone of the combustor. The combustible mixture is burned to produce hot combustion gases having a high pressure and high velocity. The combustion gases are routed towards an inlet of a turbine of the gas turbine through a hot gas path that is at least partially defined by a combustion liner and a transition duct. The combustion liner extends downstream from a cap assembly that surrounds the fuel nozzle. A forward end of the transition duct extends downstream from an aft end of the combustion liner. Thermal and kinetic energy is transferred from the combustion gases to the turbine to cause the turbine to rotate, thereby producing mechanical work. For example, the turbine may be coupled to a shaft that drives a generator to produce electricity.

High pressure combustion gases may leak out of the hot gas path at a joint formed between the aft end of the combustion liner and the forward end of the transition duct, thereby potentially impacting the overall performance of the combustor. One attempt to prevent leakage between the combustion liner and the transition duct calls for a continuous transition duct that extends from the cap assembly to an inlet of the turbine. The continuous transition duct has a circular cross section at a forward portion of the transition duct to allow for engagement with a downstream end of the cap assembly. However, the continuous transition duct shifts to a non-circular cross section generally upstream from and/or proximate to the primary combustion zone and continues to have a non-circular cross section all the way to an aft end of the continuous transition duct that terminates at the inlet of the turbine. Therefore, a continuously extending combustion liner that supports late lean fuel injection while reducing and/or preventing leakage of the high pressure combustion gases would be useful.

BRIEF DESCRIPTION OF THE INVENTION

Aspects and advantages of the invention are set forth below in the following description, or may be obvious from the description, or may be learned through practice of the invention.

One embodiment of the present invention is a combustion liner for a gas turbine combustor. The combustion liner includes an annular main body having a forward end axially separated from an aft end, and a transitional intersection defined between the forward end and the aft end. The main body extends continuously from the forward end to the aft end. A plurality of fuel injector passages extend radially through the main body upstream from the transitional intersection. The main body comprises a conical section having a circular cross section that diverges between the forward end and the transitional intersection, and a transition section having a non-circular cross section that extends from the transitional intersection to the aft end of the main body.

Another embodiment of the present invention is a combustion module for a combustor of a gas turbine. The combustion module generally includes an annular fuel distribution manifold disposed at an upstream end of the combustion module. The fuel distribution manifold includes an annular support sleeve. The combustion module further includes a fuel injection assembly having an annular combustion liner that extends downstream from the fuel distribution manifold and that terminates at an aft frame, and an annular flow sleeve that circumferentially surrounds the combustion liner. The combustion liner comprises an annular main body having a forward end axially separated from an aft end and a transitional intersection that is defined between the forward end and the aft end. The main body extends continuously from the forward end to the aft end. A plurality of fuel injector passages extend radially through the flow sleeve and the main body upstream from the transitional intersection. The main body includes a conical section that diverges between the forward end and the transitional intersection, and a transition section having a non-circular cross section that extends from the transitional intersection to the aft end of the main body.

The present invention may also include a gas turbine. The gas turbine generally includes a compressor, a compressor discharge casing disposed downstream from the compressor and a turbine disposed downstream from the compressor discharge casing, and a combustor that extends through the compressor discharge casing. The combustor includes a fuel nozzle that extends axially through an annular cap assembly and a combustion module that extends through the compressor discharge casing. The combustion module includes an annular fuel distribution manifold disposed at an upstream end of the combustion module and a fuel injection assembly having a combustion liner that extends downstream from the cap assembly and that terminates at an aft frame. The combustion module further includes an annular flow sleeve that circumferentially surrounds the combustion liner. The combustion liner comprises an annular main body having a forward end axially separated from an aft end, and a transitional intersection that is defined between the forward end and the aft end. The main body extends continuously from the forward end to the aft end of the main body. A plurality of fuel injector passages extend radially through the main body upstream from the transitional intersection. The main body comprises a conical section having a circular cross section that diverges between the forward end and the transitional intersection, and a transition section having a non-circular cross section that extends from the transitional intersection to the aft end of the main body.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
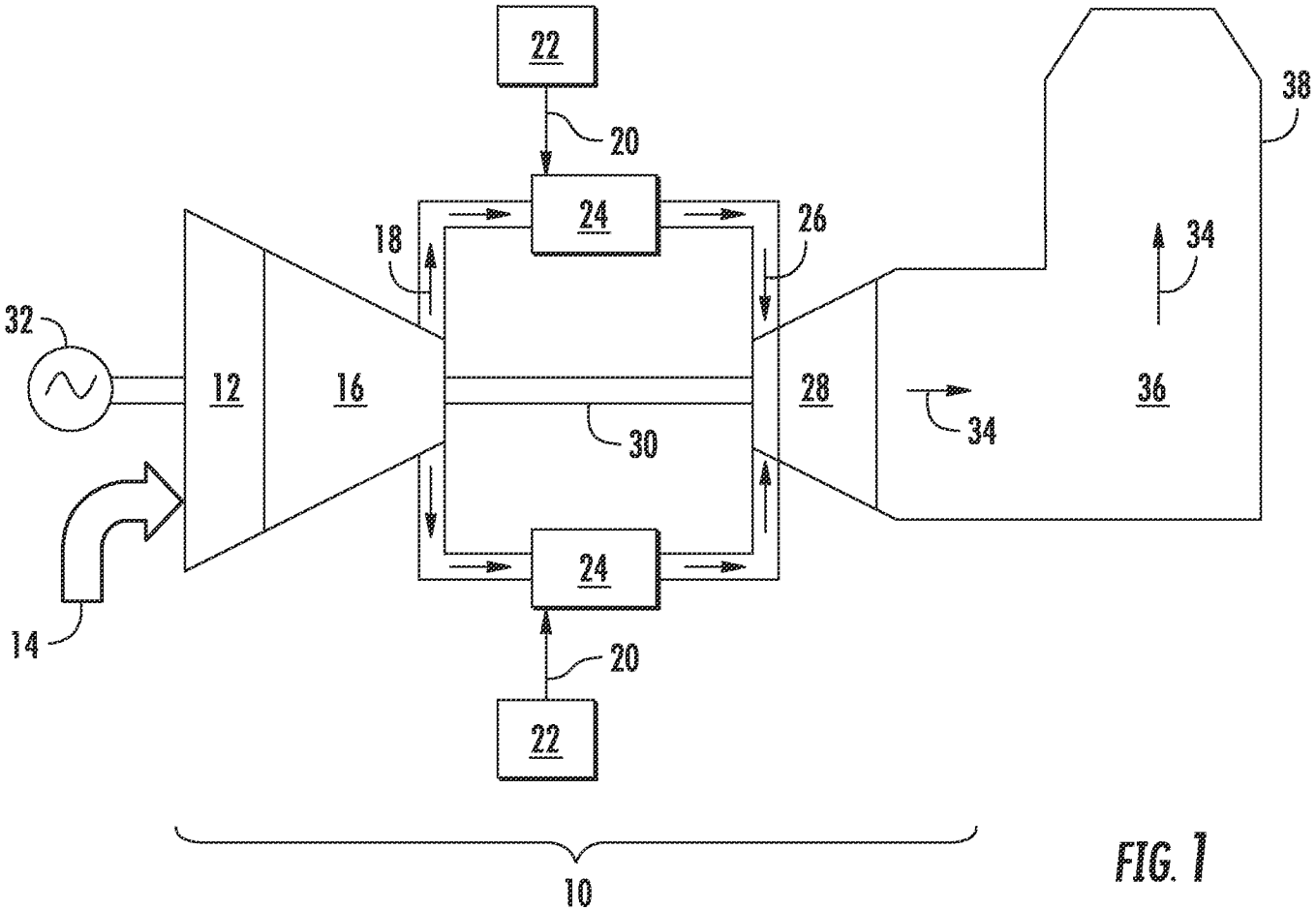
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
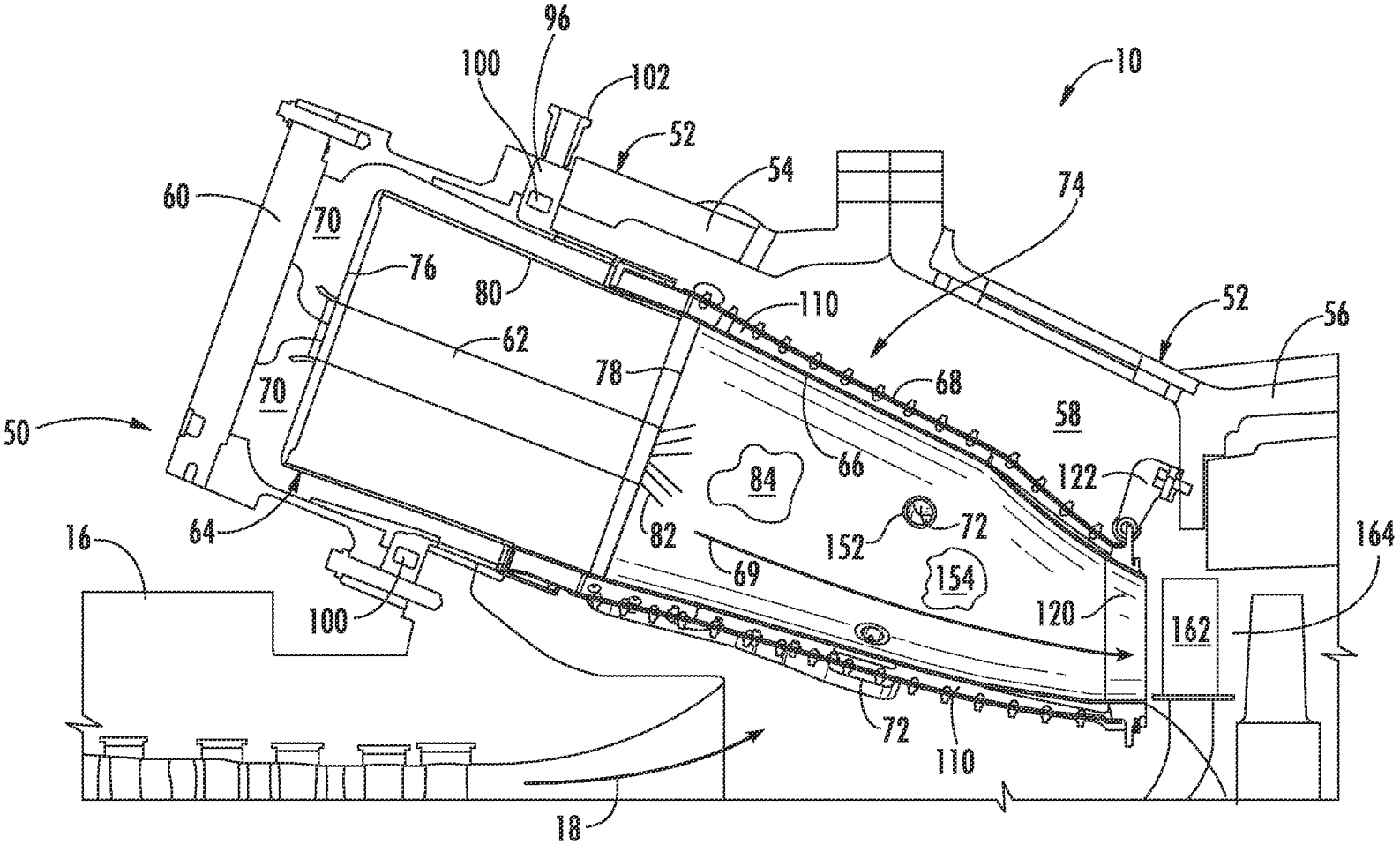
FIG. 2 is a cross sectional side view of a portion of an exemplary gas turbine, including an exemplary combustor that encompasses various embodiments of the present invention.

FIG. 2 provides a cross sectional side view of a portion of an exemplary gas turbine 10 including an exemplary combustor 50 that may encompass various embodiments of the present disclosure. As shown, the combustor 50 is at least partially surrounded by an outer casing 52 such as a compressor discharge casing 54 that is disposed downstream from the compressor and/or an outer turbine casing 56. The outer casing 52 is in fluid communication with the compressor 16 and at least partially defines a high pressure plenum 58 that surrounds at least a portion of the combustor 50. An end cover 60 is coupled to the outer casing 52 at one end of the combustor 50.

The combustor 50 generally includes at least one axially extending fuel nozzle 62 that extends downstream from the end cover 60, an annular cap assembly 64 that extends radially and axially within the outer casing 52 downstream from the end cover 60, an annular hot gas path duct or combustion liner 66 that extends downstream from the cap assembly 64 and an annular flow sleeve 68 that at least partially surrounds at least a portion of the combustion liner 66. The combustion liner defines a hot gas path 69 for routing the combustion gases 26 through the combustor 50. The end cover 60 and the cap assembly 64 at least partially define a head end 70 within the within the combustor 50. In particular embodiments, the combustor 50 further includes one or more radially extending fuel injectors 72 that extend through the combustion liner 66 and the flow sleeve 68 downstream from the at least one axially extending fuel nozzle 62. In particular embodiments, the combustion liner 66, the flow sleeve 68 and the fuel injector(s) 72 are provided as part of a combustion module 74 that extends through the outer casing 52 and that surrounds at least a portion of the cap assembly 64.

The cap assembly 64 generally includes a forward end 76 that is position downstream from the end cover 60, an aft end 78 that is disposed downstream from the forward end 76, and one or more annular shrouds 80 that extend at least partially therebetween. In particular embodiments, the axially extending fuel nozzles 62 extend at least partially through the cap assembly 64 to provide a first combustible mixture 82 of the fuel 20 (FIG. 1) and the compressed working fluid 18 to a primary combustion zone 84 defined within the combustion liner 66 downstream from the cap assembly 64.

Figure 3:
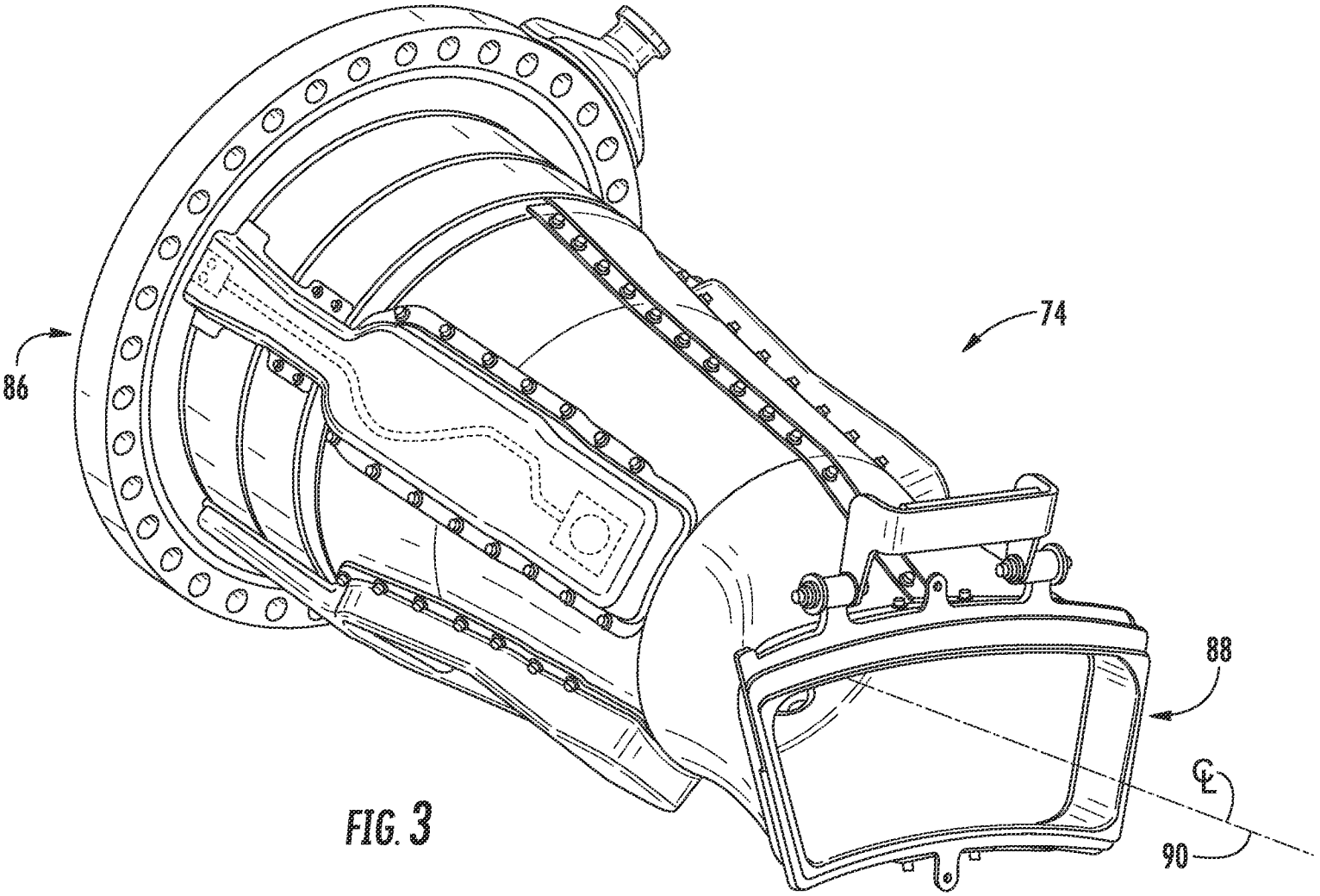
FIG. 3 is perspective view of a combustion module as shown in FIG. 2, that may encompass various embodiments of the present invention.
Figure 4:
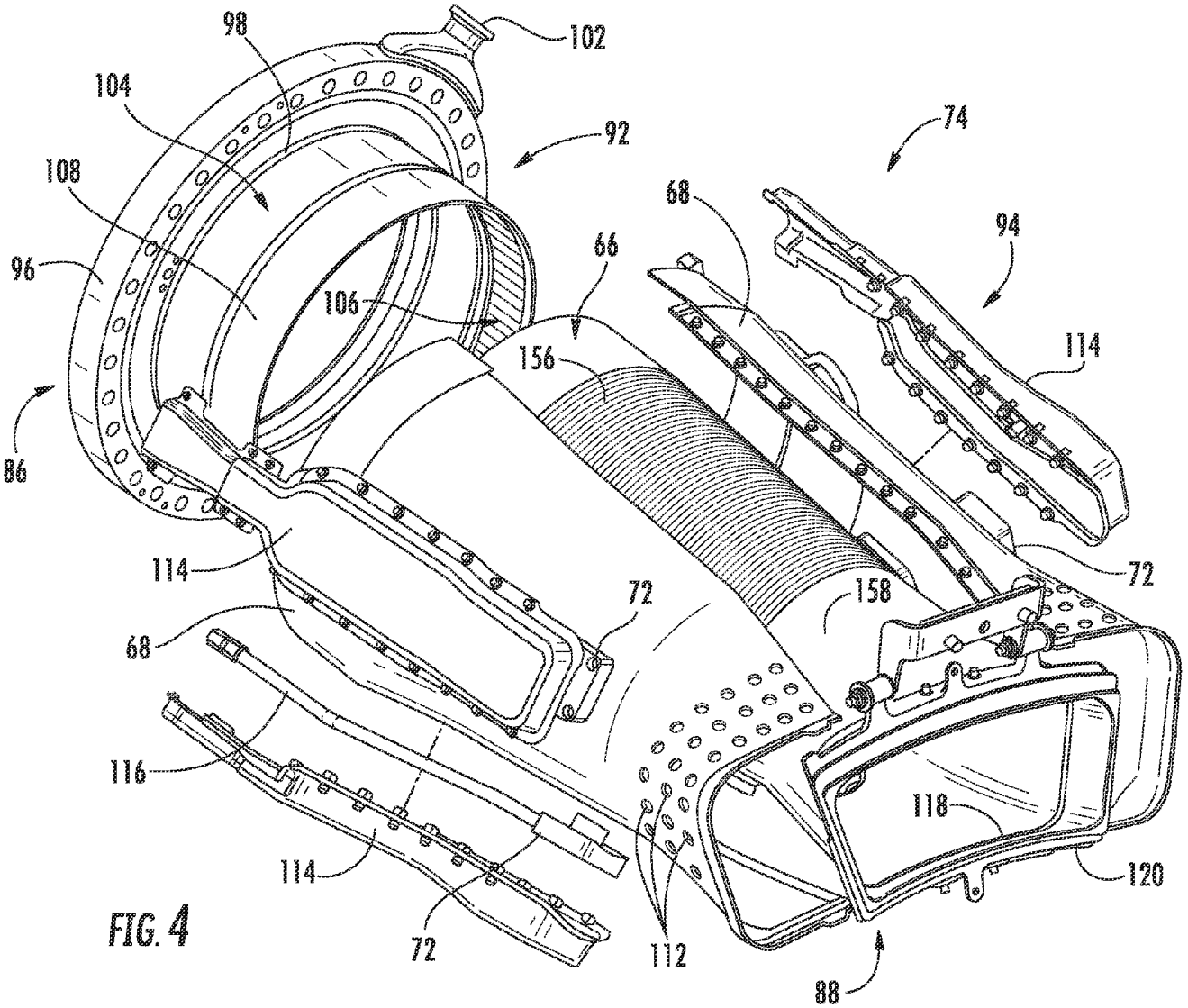
FIG. 4 is an exploded perspective view of the combustion module as shown in FIG. 3.

FIG. 3 provides a perspective view of the combustion module 74 as shown in FIG. 2, and FIG. 4 provides an exploded perspective view of the combustion module 74 as shown in FIG. 3. As shown in FIG. 3, the combustion module 74 is generally provided as an assembled or singular component. The combustion module 74 includes a forward or upstream end 86 that is axially separated from an aft or downstream end 88 with respect to an axial centerline 90 of the combustion module 74.

In particular embodiments, as shown in FIG. 4, the combustion module 74 includes an annular fuel distribution manifold 92 disposed at the upstream end 86 of the combustion module 74 and a fuel injection assembly 94 that extends downstream from the fuel distribution manifold 92 and that terminates at the downstream end 88 of the combustion module 74. The fuel distribution manifold 92 includes a radially extending mounting flange 96 that extends circumferentially around a forward end 98 of the fuel distribution manifold 92. The mounting flange 96 at least partially defines a fuel plenum 100 (FIG. 2). As shown in FIG. 4, a fuel inlet port 102 extends outward from the mounting flange 96. The fuel inlet port 102 provides for fluid communication between a fuel supply (not shown) and the fuel plenum 100 (FIG. 2). As shown in FIG. 4, the fuel distribution manifold 92 further includes an annular support sleeve 104 having an inner side portion 106 that is radially separated from an outer side portion 108.

In particular embodiments, as shown in FIG. 4 the fuel injection assembly 94 includes the combustion liner 66 and the flow sleeve 68. The flow sleeve 68 circumferentially surrounds at least a portion of the combustion liner 66. The flow sleeve 68 is radially separated from the combustion liner 66 so as to at least partially define an annular cooling flow passage 110 (FIG. 2) therebetween. The cooling flow passage 110 generally extends the length of the combustion liner 66. The flow sleeve 68 may further include a plurality of cooling or impingement holes 112 that provide for fluid communication through the flow sleeve 68 into the cooling flow passage 110 during operation of the gas turbine 10. In addition, the fuel injection assembly 94 may further include the fuel injector(s) 72 and one or more air shield(s) 114 or outer flow sleeves. In particular embodiments, each air shield 114 surrounds a corresponding fuel injector 72 to direct a portion of the compressed working fluid 18 (FIG. 2) to the fuel injector(s) 72 and into the combustion liner 66. As shown in FIG. 3, each fuel injector 72 is fluidly coupled to the fuel distribution manifold 92 through a fluid conduit 116 that extends between the fuel distribution manifold 92 and the fuel injector 72.

As shown in FIG. 2, the combustion liner 66 extends downstream from the fuel distribution manifold and an aft or downstream end 118 of the combustion liner 66 terminates at an aft frame 120 or support structure that circumferentially surrounds the aft end 118. As shown in FIGS. 2 and 4, a mounting bracket 122 may be coupled to the aft frame 120. In one embodiment, as shown in FIG. 2, the mounting bracket 122 is coupled to the outer turbine casing 56 and the mounting flange 96 of the fuel distribution manifold 92 is connected to the compressor discharge casing 54 so as to constrain the combustion module 74 at both the forward and aft ends 86, 88.

Figure 5:
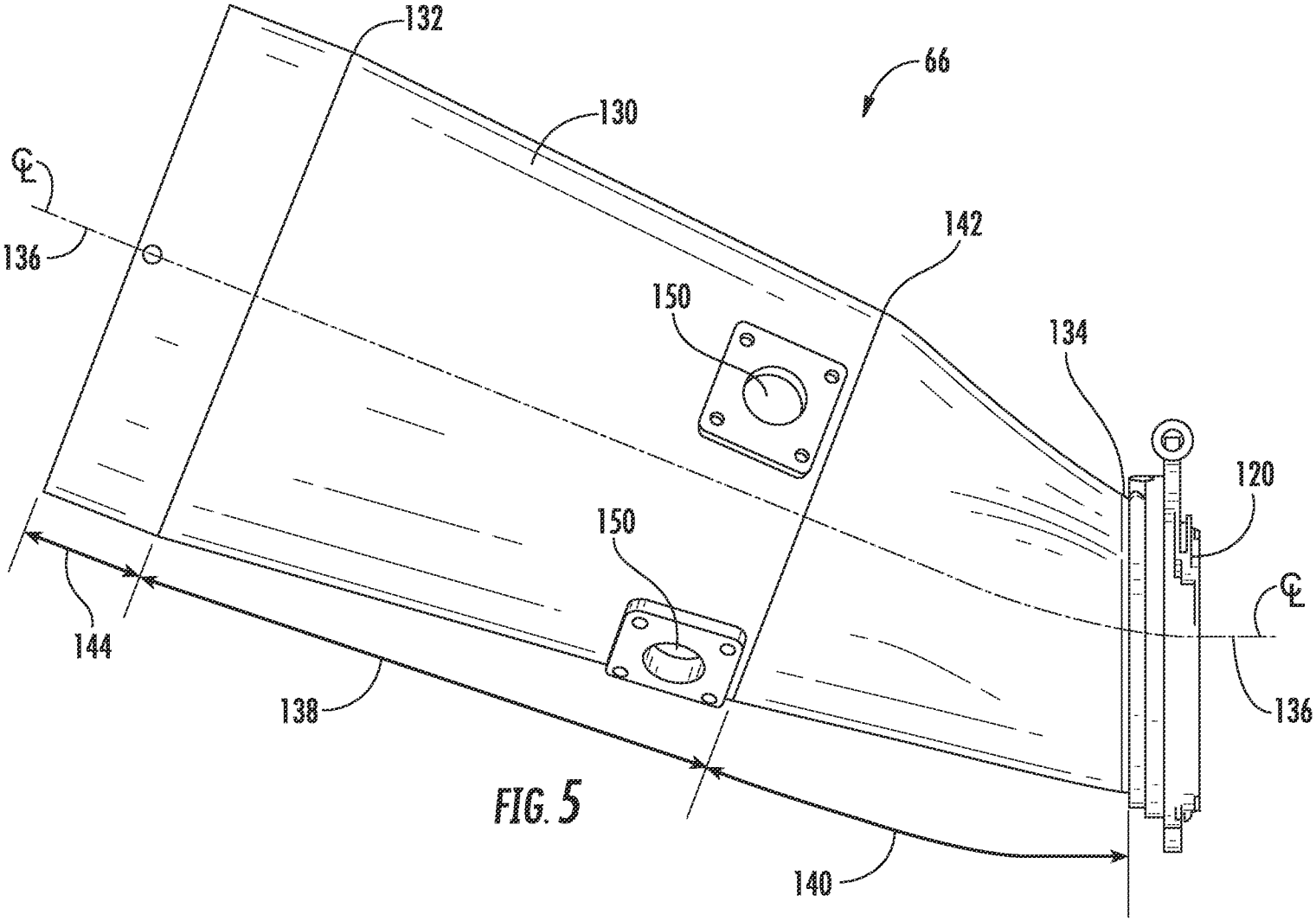
FIG. 5 is a side view of a combustion liner according to various embodiments of the present invention.
Figure 6:
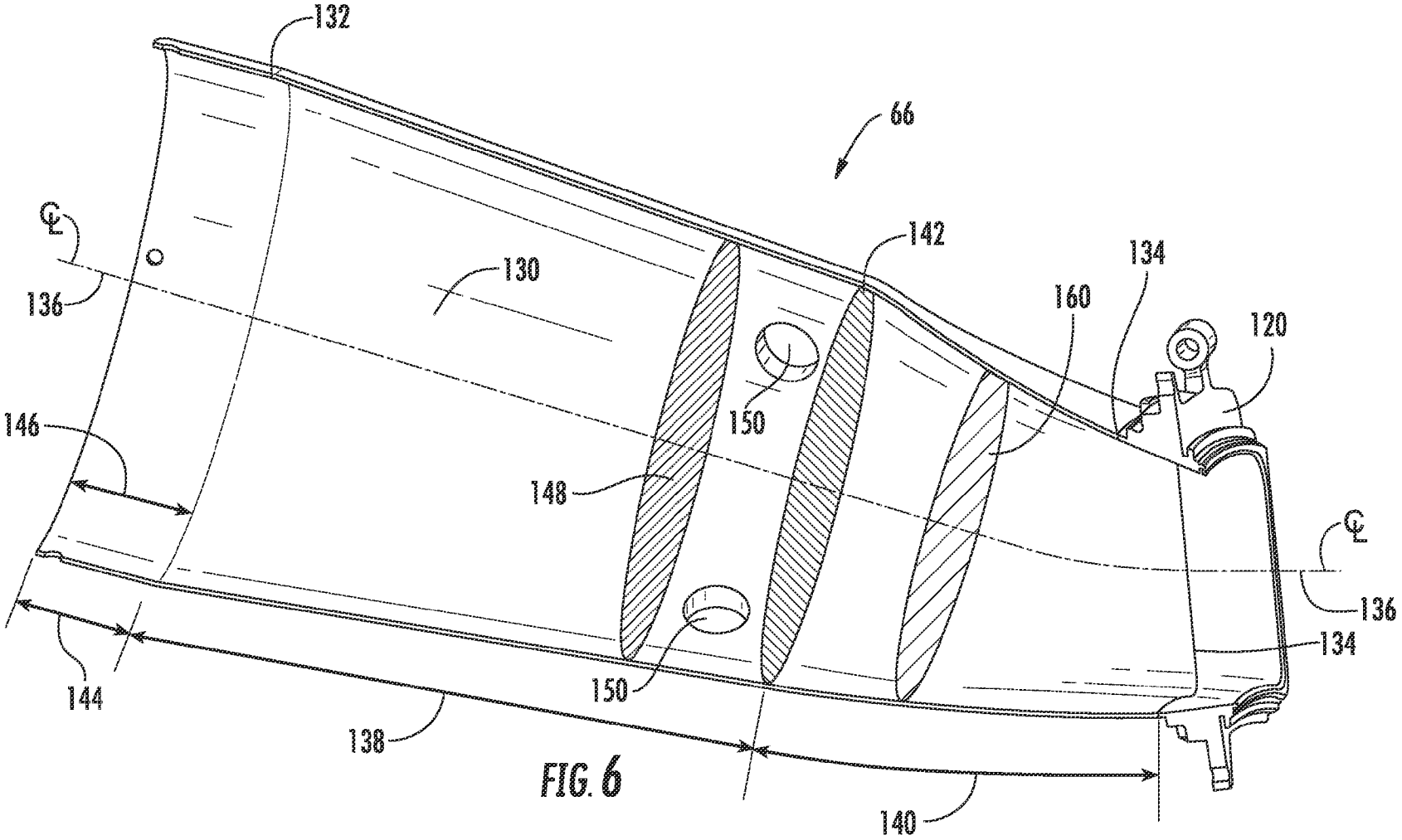
FIG. 6 is a cross sectional side view of the combustion liner as shown in FIG. 5, according to various embodiments of the present invention.
Figure 7:
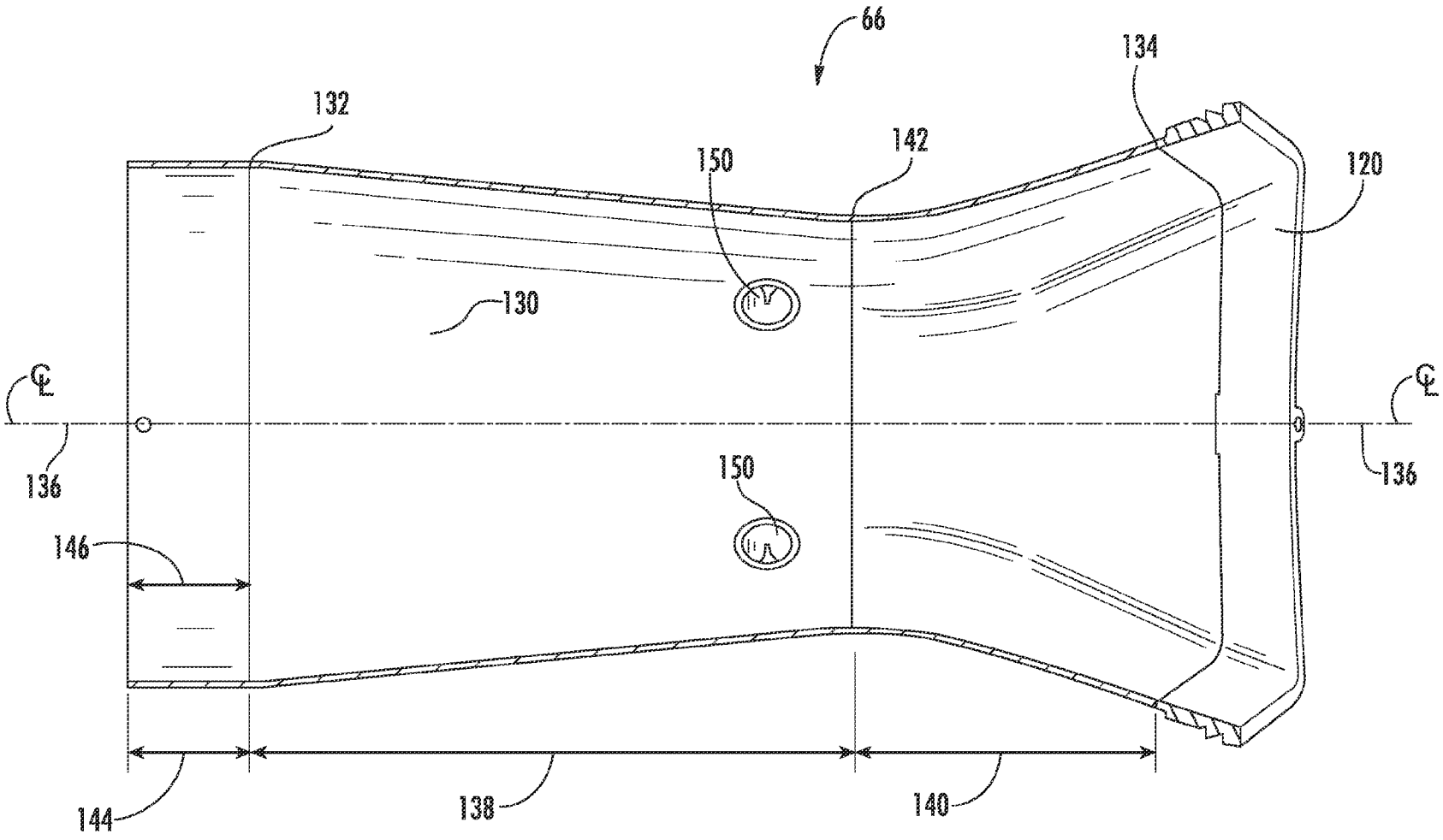
FIG. 7 is a cross-section top view of the combustion liner as shown in FIG. 5, according to at least one embodiment of the present invention.

FIG. 5 provides a side view of the combustion liner 66 according to at least one embodiment of the present disclosure, FIG. 6 provides a cross sectional side view of the combustion liner 66 as shown in FIG. 5, and FIG. 7 provides a cross sectional top view of the combustion liner 66 as shown in FIG. 5. In particular embodiments, as shown in FIGS. 5, 6 and 7, the combustion liner 66 comprises an annular main body 130.

As shown in FIGS. 5, 6 and 7, the main body 130 has a forward end 132 axially separated from an aft end 134 with respect to an axial centerline 136 of the combustion liner 66. The main body 130 extends continuously from the forward end 132 to the aft end 134. In particular embodiments, the main body 130 comprises a conical section 138 and a transition section 140. A transitional intersection 142 is defined between the forward end 132 and the aft end 134 of the main body 130 at a point where the conical section 138 and the transition section 140 intersect. For example, where the main body begins to change from a generally circular cross section to a non-circular cross section. The conical section 138 extends between the forward end 132 and the transitional intersection 140. In particular embodiments, an annular flange 144 is disposed at the forward end 132 of the main body 130. As shown in FIGS. 6 and 7, the flange 144 at least partially defines an inner engagement surface 146. As shown in FIG. 2, the inner engagement surface 146 of the flange 144 at least partially surrounds the aft end 70 of cap assembly 58.

In one embodiment, as shown in FIG. 6, the conical section 138 has a generally circular cross section 148. The circular cross section 148 remains circular between the forward end 132 and the transitional intersection 142 of the main body 130. In one embodiment, the conical section 138 diverges between the forward end 132 and the transitional intersection 134. In other words, the circular cross section 148 of the conical section 138 decreases in diameter between the forward end 132 of the main body 130 and the transitional intersection 142. In other embodiments, the conical section 138 may converge and/or diverge between the forward end 132 and the transitional intersection 134.

As shown in FIGS. 5, 6 and 7, the main body 130 at least partially defines a plurality of fuel injector passages 150 that extend radially through the conical section 138 of the main body 130 upstream from the transitional intersection 142. As shown in FIG. 2, the fuel injectors 72 provide a second combustible mixture 152 into the combustion liner 66 for combustion in a secondary combustion zone 154 (FIG. 2) that is defined within the main body 130 at and/or downstream from the fuel injector passages 150.

In particular embodiments, as shown in FIG. 3, a plurality of cooling features 156 extend radially outward from an outer surface 158 of the main body 130. The cooling features 156 may be disposed on the conical section 138 and/or the transition section 140. The cooling features 156 may include raised ribs or turbulators that at least partially surround at least a portion of the main body 130 in order to increase a rate of heat transfer between the compressed working fluid 18 that flows through the cooling flow passage 110 and the outer surface 158 of the main body 130.

As shown in FIG. 6, the transition section 140 has a generally non-circular cross section 160 that extends from the transitional intersection 142 to the aft end 134 of the main body 130. In particular embodiments, as shown in FIGS. 6 and 7, the non-circular cross section 160 of the transition section 140 is generally rectangular or oval along at least a portion of the transition section 140.

The main body 130 may be cast as a singular component so as to form a continuous main body 130. For example, the flange 144, the conical section 138 and the transition section 140 may be cast a singular component. The cooling features 156 and/or the fuel injector passages 150 may be machined and/or cast into the main body 130. In the alternative each or some of the flange 144, the conical section 138 or the transition section 140 may be formed separately. For example, the flange 144, the conical section 138 or the transition section 140 may be formed from sheet metal by rolling and/or bending and then joined by welding or other mechanical means to form a continuous main body 130. After forming, the conical section 138 may be turned to form the cooling features 156 such as turbulators or ribbed features before it is welded on to the transition section 140. In the alternative, the conical section 138 may have the cooling features 156 machined into the sheet metal prior to forming the conical shape and then welded onto the aft portion.

In operation, as shown in FIG. 2, the compressed working fluid 18 is routed from the compressor 16 into the high pressure plenum 58. A first portion of the compressed working fluid 18 is routed through the plurality of cooling or impingement holes 112 and into the cooling flow passage 110. The compressed working fluid 18 provides at least one of convective, conductive or impingement cooling to the outer surface 158 of the main body 130 of the combustion liner 66 as it travels through the cooling flow passage 110 towards the head end 70 of the combustor 50. The first portion of the compressed working fluid 18 flows reverses direction at the head end 70 and flows through and/or around the fuel nozzle 62. Fuel is injected from the fuel nozzle 62 into the first portion of the compressed working fluid 18 to provide the first combustible mixture 82 which is routed to the primary combustion zone 84 for combustion.

The combustion gases 26 flow downstream from the primary combustion zone 84 within the conical section 138 of the main body 130 of the combustion liner 66. A second portion of the compressed working fluid 18 is routed through the fuel injectors 72 where it may be mixed with fuel that flows from the fuel distribution manifold 92 to produce the second combustible mixture 152. The second combustible mixture 152 is routed into the secondary combustion zone 154 where it mixes with the combustion gases 26 from the primary combustion zone 84 and burns. As the combustion gases 26 flows from the conical section 138 to the transition section 140, the combustion gases are concentrated or oriented towards a first stage of stationary nozzles 162 that define an inlet 164 to turbine 28. The second combustible mixture 152 is generally a lean fuel-air mixture. This results in an increase in the thermodynamic efficiency of the combustor 50. The fuel injectors 72 are effective at increasing combustion gas temperatures without producing a corresponding increase in the production of undesirable emissions such as oxides of nitrogen ($NO_x$). The fuel injector(s) 72 are particularly beneficial for reducing NOx during base load and/or turndown operation of the gas turbine.

The various embodiments presented herein and as illustrated in FIGS. 2 through 7 provide various technical benefits over existing technologies. For example, the conical section 138 of the combustion liner 66 reduces hot spots caused by undesirable recirculation zones which typically form in other continuously extending transition ducts, thereby improving the durability and overall performance of the combustion liner 66. In addition, the continuous circular cross section 148 of the conical section 138 upstream from the transitional intersection 142 allows for a uniform radial spacing of the fuel injector(s) 72 around the combustion liner 66, thereby improving the benefits of late lean fuel injection such as improved performance of the combustor 50 during various operation modes of the gas turbine 10. Another benefit of the present invention is that by forming the combustion liner 66 as a continuously extending component, the number of individual components within the combustor 50 is reduced, thereby reducing costs and/or the time required for assembly. In addition, the combustion liner 66 prevents leakage of the high pressure combustion gases 26 from the hot gas path 69 which improves the overall durability and performance of the combustor 50.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustion module for a combustor of a gas turbine, comprising:

a. an annular fuel distribution manifold disposed at an upstream end of the combustion module, the fuel distribution manifold including an annular support sleeve; and b. a fuel injection assembly having an annular combustion liner that extends downstream from the fuel distribution manifold and that terminates at an aft frame, and an annular flow sleeve that circumferentially surrounds the combustion liner, the combustion liner comprising;

i. an annular main body having a forward end axially separated from an aft end and a transitional intersection defined between the forward end and the aft end, the main body extending continuously from the forward end to the aft end;

ii. a plurality of fuel injector passages that extend radially through the flow sleeve and the main body upstream from the transitional intersection; and iii. a plurality of fuel injectors that extend radially through the fuel injector passages, the fuel injectors being in fluid communication with the fuel distribution manifold;

iv. wherein the main body comprises a conical section that extends between the forward end and the transitional intersection, and a transition section having a non-circular cross section that extends from the transitional intersection to the aft end of the main body.

2. The combustion module as in claim 1, further comprising an annular flange disposed at the forward end of the main body of the combustion liner, wherein the flange defines an inner engagement surface.

3. The combustion module as in claim 1, wherein at least a portion of the transition section has a generally rectangular cross section.

4. The combustion module as in claim 1, wherein the main body of the combustion liner is cast as a singular component.

5. The combustion module as in claim 1, wherein the conical section and the transition section are joined together at the transitional intersection.

6. The combustion module as in claim 1, wherein the main body of the combustion liner further comprises a plurality of cooling features that extend radially outward from an outer surface of the main body.

7. A gas turbine, comprising:

a. a compressor, a compressor discharge casing disposed downstream from the compressor and a turbine disposed downstream from the compressor discharge casing; and b. a combustor that extends through the compressor discharge casing, the combustor having a fuel nozzle that extends axially through an annular cap assembly and a combustion module that extends through the compressor discharge casing, the combustion module having an annular fuel distribution manifold disposed at an upstream end of the combustion module and a fuel injection assembly having a combustion liner that extends downstream from the cap assembly and that terminates at an aft frame and an annular flow sleeve that circumferentially surrounds the combustion liner, the combustion liner comprising;

i. an annular main body having a forward end axially separated from an aft end and a transitional intersection defined between the forward end and the aft end, the main body extending continuously from the forward end to the aft end;

ii. a plurality of fuel injector passages that extend radially through the main body upstream from the transitional intersection; and iii. a plurality of fuel injectors that extend radially through the fuel injector passages, the fuel injectors being in fluid communication with the fuel distribution manifold;

iv. wherein the main body comprises a conical section having a circular cross section that extends between the forward end and the transitional intersection, and a transition section having a non-circular cross section that extends from the transitional intersection to the aft end of the main body.

8. The gas turbine as in claim 7, wherein the main body of the combustion liner further comprises an annular flange disposed at the forward end of the main body, wherein the flange defines an inner engagement surface.

9. The gas turbine as in claim 7, wherein at least a portion of the transition section has a generally rectangular cross section.

10. The gas turbine as in claim 7, wherein the main body of the combustion liner is cast as a singular component.

11. The gas turbine as in claim 7, Wherein the conical section and the transition section are joined together at the transitional intersection.

12. The gas turbine as in claim 7, wherein the main body of the combustion liner further comprises an outer surface and a plurality of cooling features that extend radially outward from the outer surface.

* * * * *